United States Patent [19]

Garwin

[11] 4,125,459

[45] Nov. 14, 1978

[54] HYDROCARBON SOLVENT TREATMENT OF BITUMINOUS MATERIALS

[75] Inventor: Leo Garwin, Oklahoma City, Okla.

[73] Assignee: Kerr-McGee Refining Corporation, Oklahoma City, Okla.

[21] Appl. No.: 861,858

[22] Filed: Dec. 19, 1977

Related U.S. Application Data

[63] Continuation-in-part of Ser. No. 782,116, Mar. 28, 1977, abandoned.

[51] Int. Cl.[2] ..... C10C 3/08

[52] U.S. Cl. ..... 208/309; 208/45

[58] Field of Search ..... 208/45, 309

[56] References Cited

U.S. PATENT DOCUMENTS

| | | | |
|---|---|---|---|
| 1,988,713 | 1/1935 | Bray | 208/45 |
| 2,500,757 | 3/1950 | Kiersted, Jr. | 208/45 |
| 3,627,675 | 12/1971 | Ditman et al. | 208/309 |
| 3,775,292 | 11/1973 | Watkins | 208/309 |
| 3,779,902 | 12/1973 | Mitchell et al. | 208/309 |
| 3,830,732 | 8/1974 | Gatsis | 208/309 |

FOREIGN PATENT DOCUMENTS

| | | | |
|---|---|---|---|
| 531,130 | 10/1956 | Canada | 208/45 |
| 466,524 | 7/1937 | United Kingdom | 208/309 |
| 884,229 | 12/1961 | United Kingdom | 208/45 |

*Primary Examiner*—Delbert E. Gantz
*Assistant Examiner*—Joan Thierstein
*Attorney, Agent, or Firm*—William G. Addison

[57] ABSTRACT

This invention relates to the production of oils of specified higher quality at the same yield or to the production of a higher yield of oils of the same quality from a bituminous material by a combination of propane and pentane deasphalting than would otherwise be obtainable by utilizing either propane or pentane deasphalting processes alone. This is effected by subjecting the bituminous material first to a pentane deasphalting process to produce a light fraction containing resins and oils, followed by a propane deasphalting process on the resin-oil fraction previously obtained and the recycle of at least a portion of the resins fraction back to the pentane deasphalting process. Alternatively, this is effected by subjecting the bituminous material first to a propane deasphalting process to produce a heavy fraction containing asphaltenes and resins, followed by a pentane deasphalting process on the asphaltene-resin fraction previously obtained and recycle of at least a portion of the resins fraction back to the propane deasphalting process. The oil thus produced is obtained in higher quality at the same yield or in higher yield at the same quality by virtue of the ability to cut deeper into the residuum than otherwise would be possible.

4 Claims, 3 Drawing Figures

HYDROCARBON SOLVENT TREATMENT OF BITUMINOUS MATERIALS

CROSS REFERENCE TO RELATED APPLICATIONS

This application is a continuation-in-part of my copending application Ser. No. 782,116 entitled "Hydrocarbon Solvent Treatment of Bituminous Materials" filed Mar. 28, 1977 now abandoned.

BACKGROUND OF THE INVENTION

1. Field of the Invention

This invention relates to an improvement in a process to produce by a combination of propane and pentane deasphalting an oil of a specified quality from a bituminous material that would otherwise by unobtainable in the same yield by pentane or propane deasphalting processes alone, or in the alternative, to produce a higher yield of comparable quality oil from the bituminous material.

2. Brief Description of the Prior Art

Many methods of extracting bituminous materials have been disclosed previously in the art, perhaps the most well-known of these being propane extraction in which asphaltic materials are recovered from bituminous materials such as reduced crudes by means of a single-solvent extraction. In such extraction, plugging of the extraction equipment may occur in the section between the point of introduction of the propane, thereby making continuous operation difficult.

It has been recognized that the tendency toward plugging in conventional propane deasphalting installations increases with an increase in the concentration of the asphaltenes in the bituminous material. Therefore, this tendency toward plugging acts as a direct limit on the yield of high quality oil product that may be extracted from the bituminous material and successfully separated from the asphaltic product. Any attempt to increase this yield results in a decrease in quality of the oil product that may be extracted from the bituminous material and successfully separated from the asphaltic product. The decrease in quality of the oil product is due to a failure to completely separate it from the asphaltic product.

U.S. Pat. No. 3,053,751 suggests that the plugging problem may be overcome through the utilization of elevated temperatures and pressures. However, the imposition of such new conditions in existing installations presupposes that such installations are capable of operating at pressures higher than those for which they were originally designed or at which they originally functioned.

U.S. Pat. No. 2,500,757 discloses a deasphalting process which requires at least three stages. A liquefied normally gaseous hydrocarbon is mixed with the feed and introduced into a first separation zone maintained at a first temperature level. The feed is separated into a resin-oil phase and an asphaltic phase. The resin-oil phase is removed and introduced into a second separation zone maintained at a second temperature level to separate the resin-oil phase into a resin phase and an oil phase. The oil phase is recovered as product and the resin phase is recycled to the first separation zone. The asphaltic phase is removed from the first separation zone and mixed with additional solvent. It then is introduced into a third separation zone maintained at a third temperature level and allowed to separate into additional oil and asphaltic phases. The oil phase is recycled to the first separation zone and the asphaltic phase is removed and mixed with still more additional solvent before introduction into a fourth separation zone. In the fourth separation zone, maintained at a fourth temperature level, the asphaltic phase separates into a substantially deoiled asphalt phase and an oil phase. The oil phase then is recycled to the third separation zone. The disadvantages of this process are the number of separation zones required, the many different temperature levels which must be maintained and the necessity of adding additional solvent to the separated asphaltic phase entering subsequent separation zones.

U.S. Pat. No. 2,940,920 discloses that solvents other than the light hydrocarbons in the $C_2$ to $C_4$ range may be used to separate a bituminous material into at least two fractions at a greatly improved rate of separation and in a manner which eliminates certain prior art operating difficulties encountered in the use of propane-type solvents. Such patent discloses effectuating the separation through the utilization of high temperature-pressure techniques and pentane as one of a group of suitable solvents. The use of that method of separation permits a deeper cut to be made in the bituminous material, but as a consequence, more resinous bodies are present in the oil fraction which tend to decrease the quality of said oil.

Thus, the pentane process (U.S. Pat. No. 2,940,920) alone will produce an oil product in increased yields over propane deasphalting processes but not at a comparable quality, the pentane extracted oil product being heavier and darker by virtue of contained resins from which it was separated in the last phase of the pentane process. This small quantity of resinous bodies results in an oil product that is higher in carbon residue, in sulfur, and most importantly, in metals. In this condition, the oil product is not as suitable as most solvent refined oils either for catalytic cracking charge due to its high metals content or for lubricating stock manufacture because of its resinous bodies content.

SUMMARY OF THE INVENTION

The surprising discovery has now been made that if the solvent-free light fraction product stream of a pentane deasphalting process is subjected to a secondary propane deasphalting process, an oil of higher quality can be produced from a bituminous material than could otherwise be obtained at comparable yields by either the propane or pentane deasphalting processes alone. Taking the solvent-free light fraction product stream, pentane extracted oil, as contemplated by this invention, and subjecting it to propane treatment, after which a portion of the separated resins is recycled to the pentane process, results in a specified oil product improved in yield by virtue of the fact that contaminants which would otherwise be present from pentane treatment alone are rejected as part of the asphaltic product from the propane treatment. In this way, by following a pentane treatment which produces oil not of prime usable quality, due to the poorer selectively of pentane, with a secondary propane treatment, a higher yield of prime quality oil of specified higher quality will be produced from the asphalt itself. Such oil, without benefit of the pentane-propane processing treatment, would have remained in the original asphalt and been disposed of in fuel oil or other low value products rather than being upgraded into a much more valuable product.

Alternatively, the bituminous material may be subjected to propane treatment followed by pentane treatment and a portion of the separated resins can be recycled to the propane treatment zone.

DESCRIPTION OF THE PREFERRED EMBODIMENTS

Figure 1:
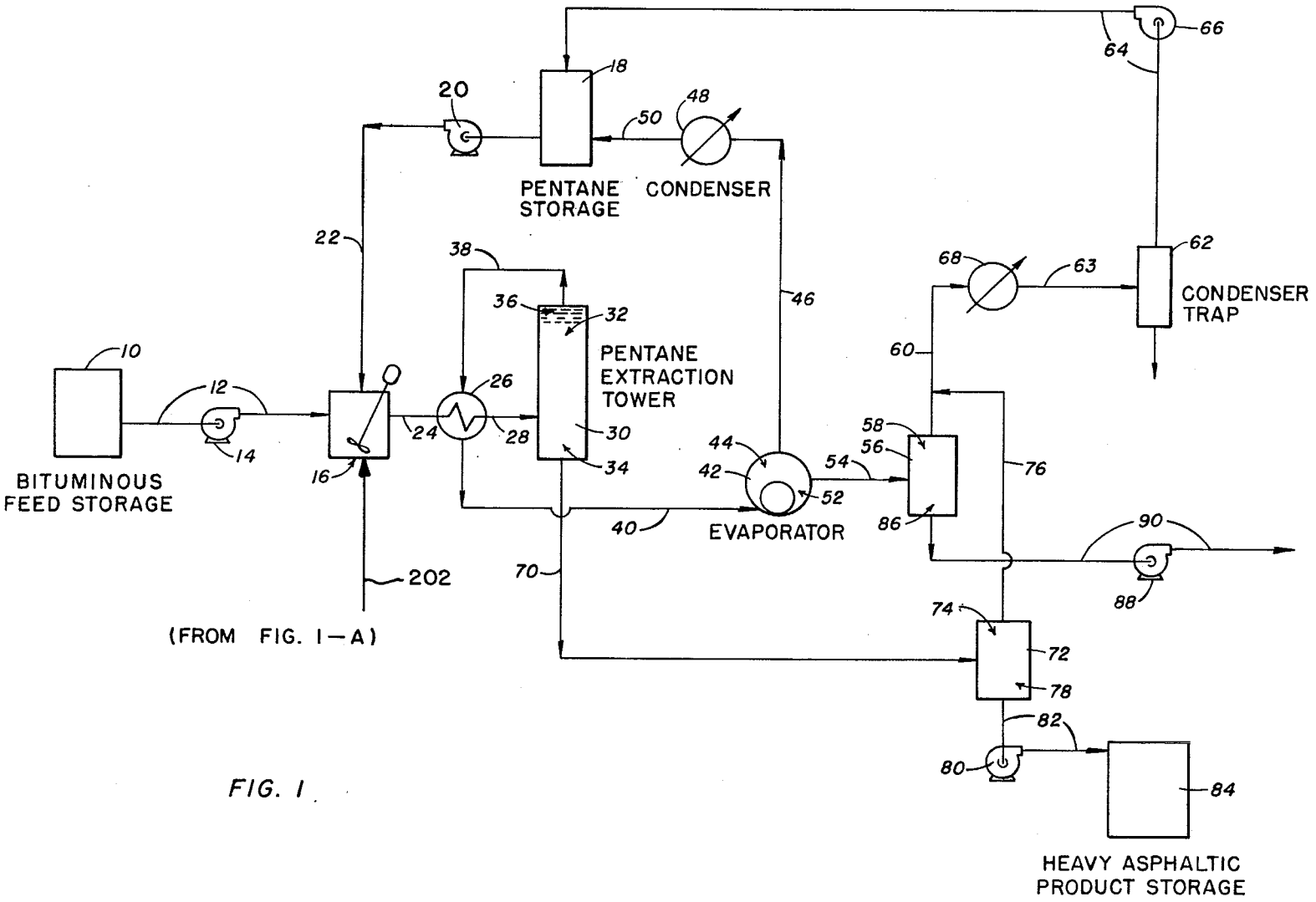
FIGS. 1 and 1-A diagrammatically and schematically illustrate one form of apparatus suitable for practicing the present invention.
Figure 1A:
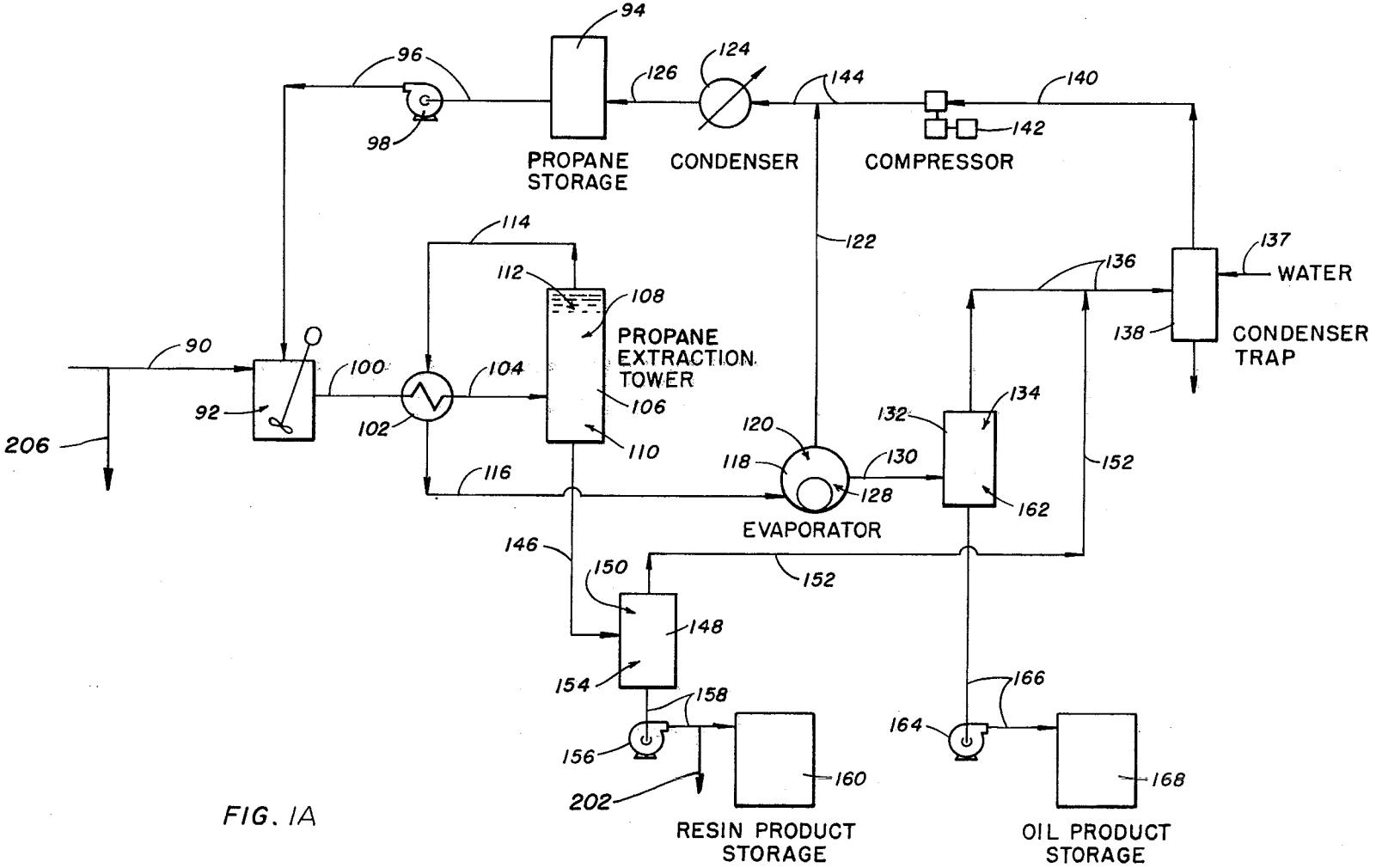

Turning first to FIG. 1, a vessel 10 is provided as a storage means for the feed stock of bituminous material. The feed stock in vessel 10 is pumped through a line 12 by a pump 14 to a mixing vessel 16 where pentane is introduced. A vessel 18 serves as the pentane accumulator and storage vessel. The pentane from vessel 18 is pumped by a pump 20 through a line 22 to mixing vessel 16 where it contacts the bituminous material feed.

The mixture from vessel 16 then passes by a line 24 through a feed heat exchanger 26, wherre it is heated. The heated feed then flows through a line 28 to enter a phase separating vessel such as pentane extraction tower 30 wherein it is separated into a light fraction in an upper portion 32 of tower 30 and a heavy fraction in a lower portion 34 of tower 30.

The temperature level in tower 30 is maintained in a range of from about 350° F. to about 425° F. and the pressure level is maintained at least equal to the actual or extrapolated vapor pressure of the pentane at its highest temperature in tower 30.

The separation is effected by maintaining an interface level in tower 30. A temperature differential to provide some reflux and to enhance the separation is maintained by the use of a heating coil system 36 in the top section of tower 30. The bottom temperature of tower 30 normally is operated at about 380° F. and the top is operated at about 400° F., when the pressure is about 550 p.s.i.g.

The solvent containing light fraction from the upper portion 32 of tower 30 flows by pressure control through a line 38 to the feed heat exchanger 26 where heat is transferred to the feed stock. Thereafter, the light fraction flow by a line 40 to a phase separating vessel 42 for evaporation of the pentane solvent. In vessel 42, a high temperature heating medium such as steam is utilized to heat the light fraction stream to create a two-phase condition necessary to effectuate the solvent separation.

A light fraction formed in an upper portion 44 of vessel 42, comprising substantially pentane vapor, passes by a line 46 directly to a condenser 48 where it is condensed and then to a line 50 to return to the pentane accumulator vessel 18.

A heavy fraction formed in a lower portion 52 of vessel 42, comprising a resin and oil mix, flows on level control by a line 54 to the top of a phase separating vessel 56 where the final traces of pentane are removed by steam stripping.

A light fraction formed in an upper portion 58 of vessel 56, comprising substantially the last traces of pentane solvent vapors, flows by a line 60 to a condenser 68 and then through a line 63 to a pentane-water separating vessel 62. Water is drained from the bottom of separating vessel 62. Pentane from the the upper portion of vessel 62 is pumped by a pump 66 via a line 64 to pentane storage vessel 18 for recirculation.

The heavy fraction formed in the lower portion 34 of vessel 30 is withdrawn by a line 70 and introduced into a phase separating vessel 72 for steam stripping of the final traces of pentane still remaining in the heavy asphaltic product stream.

A light fraction formed in an upper portion 74 of vessel 72, comprising substantially pentane vapor, flows by a line 76 to connect with line 60 before entry into condenser 68 for eventual recirculation as shown in FIG. 1.

A heavy fraction formed in a lower portion 78 of vessel 72, comprising heavy asphaltic product, is pumped by a pump 80 through a line 82 to a vessel 84 for storage.

A heavy fraction formed in a lower portion 86 of vessel 56, comprising a solvent-free resin and oil mix, is withdrawn by a pump 88 through a line 90.

Turning now to FIG. 1-A, at least a portion of the resin and oil mixture in line 90 enters a vessel 92 for contacting with propane solvent. A vessel 94 serves as a propane accumulator and storage vessel. The propane travels from vessel 94 through a line 96 via pumping by a pump 98 to enter mixing vessel 92 where it is contacted with the resin and oil mixture to form a new feed stock-solvent stream. A portion of the resin and oil mixture in line 90 can be withdrawn as a product in a line 206.

The newly formed feed stock-solvent stream thereupon enters a heat exchanger 102 by a line 100 where it is adjusted in temperature. The feed stream leaving heat exchanger 102 then flows by a line 104 into a propane extraction tower 106 wherein it is separated into a light fraction in an upper portion 108 of tower 106 and a heavy fraction in a lower portion 110 of tower 106.

The temperature level in tower 106 is maintained in a range of from about 125° F. to about 200° F. and the pressure level is maintained at least equal to the actual or extrapolated vapor pressure of the propane at its highest temperature in tower 106.

The separation is effected by maintaining an interface level in tower 106. A temperature differential to provide some reflux and to enhance the separation is maintained by the use of a heating coil system 112 in the top section of tower 106. The bottom temperature of tower 106 normally is operated at about 130° F. and the top is operated at about 150° F. when the pressure is about 450° p.s.i.g.

The light fraction formed in the upper portion 108 of tower 106, comprising oils and solvent, flows by pressure control through a line 114 to the feed heat exchanger 102 and thereafter by a line 116 to a phase separating vessel 118 for evaporation of the propane solvent. In vessel 118 steam is utilized to create a two-phase system by heating the product stream to effect the solvent removal.

A light fraction formed in an upper portion 120 of vessel 118, comprising substantially propane vapor, is conveyed through a line 122 to enter a line 144 for passage to a condenser 124 where it is condensed and withdrawn through a line 126 to return to the propane storage vessel 94 for recirculation.

A heavy fraction formed in a lower portion 128 of vessel 118, comprising oils, flows on level control through a line 130 to a phase separating vessel 132 where the final traces of propane are removed by steam stripping.

A light fraction formed in an upper portion 134 of vessel 132, comprising substantially propane vapor, flows by a line 136 to a vessel 138 which operates as a water condenser-suction trap. Cold water enters vessel 138 via line 137. The propane vapor from vessel 138 thereafter flows by a line 140 to a compressor 142 where it is compressed and discharged into a line 144 for flow into condenser 134 and eventual recirculation, as shown in FIG. 1-A. Water is drained from the bottom of condenser-suction trap vessel 138.

The heavy fraction formed in the lower portion 110 of tower 106, comprising resins, flows from the base of tower 106 through a line 146 to a phase separating vessel 148 for stripping of the final traces of propane.

A light fraction formed in an upper portion 150 of vessel 148, comprising substantially the last traces of propane vapor presnt in the resin product, is withdrawn through a line 152 and enters line 136 for flow into the water condenser-suction trap vessel 138 for eventual recirculation, as shown in FIG. 1-A.

A heavy fraction formed in a lower portion 154 of vessel 148, comprising resins, is pumped by a pump 156 through a line 158 to a resin product storage vessel 160 for storage of the resin product. At least a portion of the resin fraction flowing in line 158 is withdrawn through a line 202 for recycle to the mixing vessel 16 for recontacting additional pentane and subsequent separation in vessel 30.

The heavy fraction formed in a lower portion 162 of vessel 132, comprising oils, is withdrawn by means of a pump 164 through a line 166 to an oil product storage vessel 168 for storage of the oil product. The oil thus produced is obtained in higher quality at the same yield than otherwise would be possible.

It is to be understood that the herein described preferred embodiments of this invention are for illustration purposes only and that this invention may be varied or modified without departing from the spirit and scope thereof as defined in the appended claims.

Figure 2:
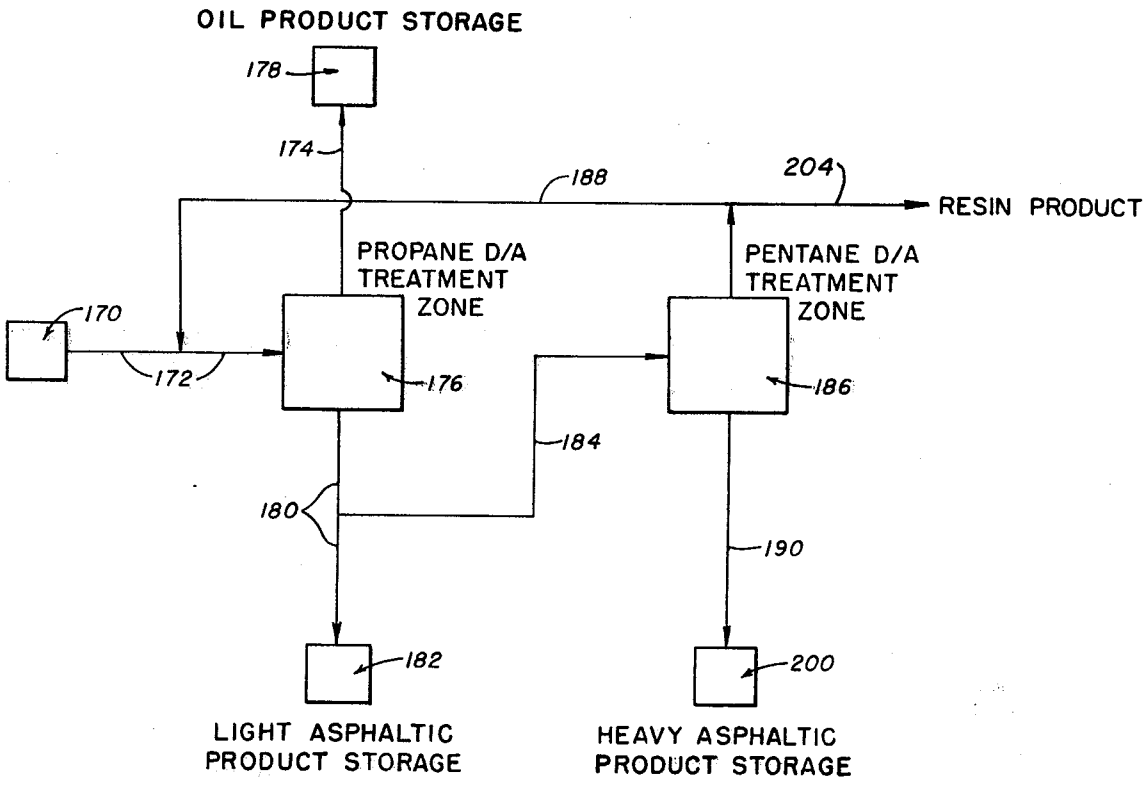
FIG. 2 diagrammatically and schematically illustrates another form of apparatus suitable for practicing the present invention.

In this regard, turning now to FIG. 2, a simple diagrammatic, schematic illustration of an alternate means of practicing the present invention is provided.

A vessel 170 is provided as a storage means for the bituminous material feed. The bituminous material feed flows by a line 172 to a propane deasphalting treatment zone 176 to produce a light fraction product comprising substantially oils and a heavy fraction product comprising substantially a light asphaltic product.

The propane deasphalting treatment zone is maintained at a temperature level of from about 125°–200° F. and a pressure level at least equal to the actual or extrapolated vapor pressure of the solvent at its highest temperature in the treatment zone.

The light asphaltic product is withdrawn from the treating zone 176 by a line 180 to a light asphatlic product storage vessel 182 for storage. A slip stream portion of the light asphaltic product in line 180 is removed by a line 184. This slip stream is utilized as a feed material to a pentane deasphalting treatment zone 186.

The pentane deasphalting treatment zone is maintained at a temperature level of from about 350°–425° F. and a pressure level at least equal to the actual or extrapolated vapor pressure of the solvent at its highest temperature in the treatment zone.

The purpose of subjecting this portion of the light asphaltic product to a pentane deasphalting process is to cut deeper into the residuum to recover more of the useful oils. At least a portion of a light fraction product from the pentane deasphalting treatment zone 186 is returned by a line 188 for recycle into line 172. The remaining portion of the light fraction product of the pentane deasphalting treatment zone 186, comprising resins, can be withdrawn by a line 204 as a resin product. The result of this is an increase in the production of high quality oils not otherwise obtainable at comparable yields by either pentane or propane deasphalting treatment alone.

The light fraction product separated in propane deasphalting zone 176 is withdrawn by a line 174 to pass to an oil product storage vessel 178 for storage or feed to other downstream processing units (not shown).

The heavy asphaltic product from the pentane deasphalting treatment zone 186 is withdrawn by a line 190 to a heavy asphaltic product storage vessel 200 for storage or use in other downstream processing units (not shown). The heavy asphaltic product may also be returned to mix with the light asphaltic product contained in vessel 182 for storage or other downstream processing units (not shown).

The term "bituminous material" as used herein and in the claims is intended to include pyrogenous bitumens and native bitumens, one or more fractions or components thereof, or products obtained by treating these materials or one or more of their components or fractions with air or another oxygencontaining gas in the presence or absence of catalysts. The pyrogenous bitumens include some of the heavy or very low API gravity petroleum crudes, reduced crudes, either steam or vacuum refined, hard and soft wood pitches, coal tar residues, cracked tars, tall oil, vegetable pitches and the like and the native bitumens include gilsonite, wurtzilite, albertite and native asphalt, for instance, Trinidad asphalt and the like.

The term "light fraction" as used herein and in the claims is intended to define a portion of a homogeneous mixture that has separated from the mixture in a suitable vessel or zone and possesses a density less than that of the mixture.

The term "heavy fraction" as used herein and in the claims is intended to define a portion of a homogeneous mixture that has separated from the mixture in a suitable vessel or zone and possesses a density greater than that of the mixture.

What is claimed is:

1. In the process which comprises treating a bituminous material to separate same into at least two fractions by contacting said bituminous material with a first solvent in a first treating zone at elevated temperature and pressure to cause said bituminous material to separate into a first light fraction and withdrawing the first light fraction and the first heavy fraction for recovery, and then contacting at least a portion of said first heavy fraction with a second solvent in a second treating zone at an elevated temperature and pressure to cause said first heavy fraction to separate into a second light fraction comprising substantially oils and resins and a second heavy fraction which are withdrawn separately for recovery, the improvement which comprises:

recycling at least a portion of the second light fraction to the first treating zone to separate and recover additional high quality oils from the bituminous material.

2. The process of claim 1 in which:

the first solvent is propane and the first treating zone is maintained at a temperature level in the range of from about 125°-200° F. and a pressure level at least equal to the actual or extrapolated vapor pressure of the first solvent at its highest temperature in the first treating zone; and the second solvent is pentane and the second treating zone is maintained at a temperature level in the range of from about 350°-425° F. and a pressure level at least equal to the actual or extrapolated vapor pressure of the second solvent at its highest temperature in the second treating zone.

3. In the process which comprises treating a bituminous material to separate same into at least two fractions by contacting said bituminous material with a first solvent in a first treating zone at elevated temperature and pressure to cause said bituminous material to separate into a first light fraction and a first heavy fraction comprising substantially asphaltenes and withdrawing the first light fraction and the first heavy fraction for recovery, and then contacting at least a portion of said first light fraction with a second solvent in a second treating zone at an elevated temperature and pressure to cause said first light fraction to separate into a second light fraction comprising substantially oils and a second heavy fraction comprising resins which are withdrawn separately for recovery, the improvement which comprises:

recycling at least a portion of the second heavy fraction to the first treating zone to separate and recover additional high quality oils from the bituminous material.

4. The process of claim 3 in which:

the first solvent is pentane and the first treating zone is maintained at a temperature level in the range of from about 350° F. to about 425° F. and a pressure level at least equal to the actual or extrapolated vapor pressure of the first solvent at its highest temperature in the first treating zone; and the second solvent is propane and the second treating zone is maintained at a temperature level in the range of from about 125° F. to about 200° F. and a pressure level at least equal to the actual or extrapolated vapor pressure of the second solvent at its highest temperature in the second treating zone.

* * * * *